US005408766A

United States Patent [19]

Pobihushchy

[11] Patent Number: 5,408,766

[45] Date of Patent: Apr. 25, 1995

[54] HYDRAULIC EXCAVATING MACHINE

[76] Inventor: Victor Pobihushchy, Site 15, Box 1, R. R. 1, Red Deer, Alberta, Canada, T4N 5E1

[21] Appl. No.: 53,376

[22] Filed: Apr. 28, 1993

[51] Int. Cl.[6] ..... E02F 3/88

[52] U.S. Cl. ..... 37/323; 37/347; 37/905

[58] Field of Search ..... 37/905, 347, 348, 317, 37/320, 321, 323, 334; 239/129, 146, 176, 195, 198

[56] References Cited

U.S. PATENT DOCUMENTS

| | | | |
|---|---|---|---|
| 4,936,031 | 6/1990 | Briggs | 37/347 |
| 5,140,759 | 8/1992 | Artzberger | 37/347 |
| 5,295,317 | 3/1994 | Perrott | 37/905 X |

FOREIGN PATENT DOCUMENTS

| | | | |
|---|---|---|---|
| 556502 | 4/1958 | Canada . | |
| 936705 | 11/1973 | Canada . | |
| 1105893 | 7/1981 | Canada . | |
| 2032235 | 6/1991 | Canada . | |
| 4277226 | 10/1992 | Japan | 37/905 |

*Primary Examiner*—Dennis L. Taylor
*Assistant Examiner*—Victor Batson
*Attorney, Agent, or Firm*—Antonelli, Terry, Stout & Kraus

[57] ABSTRACT

A hydraulic excavating machine of the type that utilizes a jet of water to loosen soil, the loosened soil and water then being removed from the excavation by suction, comprises a self-propelled vehicle having a holding tank for receiving the excavated soil and water, and a supply tank from which the water is delivered under pressure. The holding tank communicates with a large diameter suction conduit that is carried in a coil on top of the tank and extends along a boom and then downwardly into the excavation. The boom is at a fixed elevation relative to the vehicle, and therefore can operate in locations where there is limited head room.

30 Claims, 3 Drawing Sheets

HYDRAULIC EXCAVATING MACHINE

BACKGROUND OF THE INVENTION

1. Field of the Invention

This invention relates to a new or improved excavating apparatus of the type that employs a high pressure jet of fluid to excavate holes or trenches in soil, the loosened soil and fluid being drawn out of the excavation under vacuum.

2. Description of the Prior Art

It is known to provide equipment of this type in the form of a self-propelled vehicle having a vacuum conduit leading to a tank in the vehicle and extending along the length of a boom which is pivoted on the vehicle about a horizontal axis to allow the cutting end of the conduit to be lowered vertically into the ground. Such apparatus however requires considerable headroom for the luffing movement of the boom, and there is always the danger that the boom may foul obstructions such as overhead power lines.

SUMMARY OF THE INVENTION

According to the invention there is provided a soil excavating apparatus comprising: a platform; an elongate boom mounted on said platform and having a free end that is angularly movable in a horizontal direction about said platform; an extendible flexible tubular conduit carried by said boom and having one end associated with said platform and connectable to a source of suction, said conduit extending longitudinally of the boom and having a portion leading to the second end thereof suspended to hang vertically from said boom at a spacing from said platform, said portion terminating in a tubular pipe that carries downwardly directed nozzle means near the lower end thereof; said conduit being extendible and retractable to selectively raise or lower said pipe independently of said boom, and said nozzle means being angularly shiftable about the axis of said pipe; the arrangement being such that said pipe can be lowered into the ground to excavate a hole by delivery of high pressure fluid through said nozzle means to loosen soil, and by removable of such loosened soil through said conduit by suction.

Since the pipe at the end of the conduit can be raised or lowered independently of the boom, the latter can be "raiseless" i.e. arranged at a fixed height, being capable only of pivoting about a vertical axis. This enables the apparatus to work in situations where there is limited headroom and avoids the danger of the boom fouling overhead power lines.

The apparatus is preferably provided on a vehicle, the platform being pivotally mounted on the top of the vehicle and the boom pivoting with the platform and extending radially therefrom so that it can be located anywhere throughout a wide angular arc around the vehicle. The boom is preferably also telescopically extensible and retractable to increase the effective operating area of the apparatus. The vehicle preferably includes a holding tank to receive displaced soil and spent water drawn through the conduit, the holding tank being placed under vacuum by a large capacity fan or the like. The bottom of the holding tank has sloping walls leading to an elongated trough wherein an auger is arranged to deliver soil from the holding tank to a discharge outlet.

The vehicle preferably also includes water supply tanks one on each side of the holding tank. The water tanks are heated, e.g. by running the vehicle exhaust through them, so that the apparatus can operate in cold weather conditions. High pressure water drawn from these tanks can be further heated in a coil boiler or the like, thus enabling the apparatus to operate in frozen soil since the hot water will thaw the soil.

The holding tank preferably includes blow-out panels to avoid destruction of the tank in the event that explosive gases are drawn into it, as can occur, for example, where excavation is being done in the vicinity of buried gasoline tanks or gas pipelines.

BRIEF DESCRIPTION OF THE DRAWINGS

The invention will further be described, by way of example only, with reference to the embodiment illustrated in the accompanying drawings wherein.

DESCRIPTION OF THE PREFERRED EMBODIMENT

Figure 1:
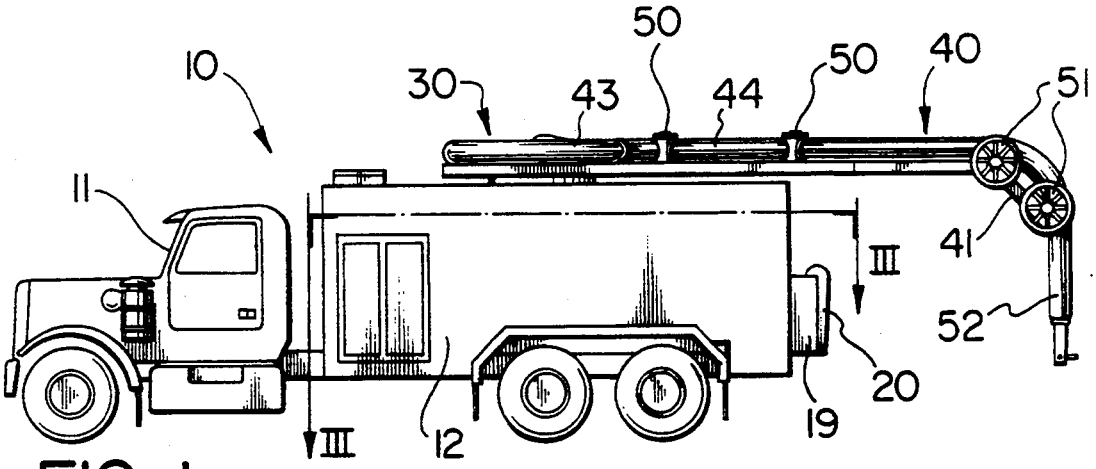
FIG. 1 is a side view of a vehicle that includes soil excavating apparatus in accordance with the invention.
Figure 3:
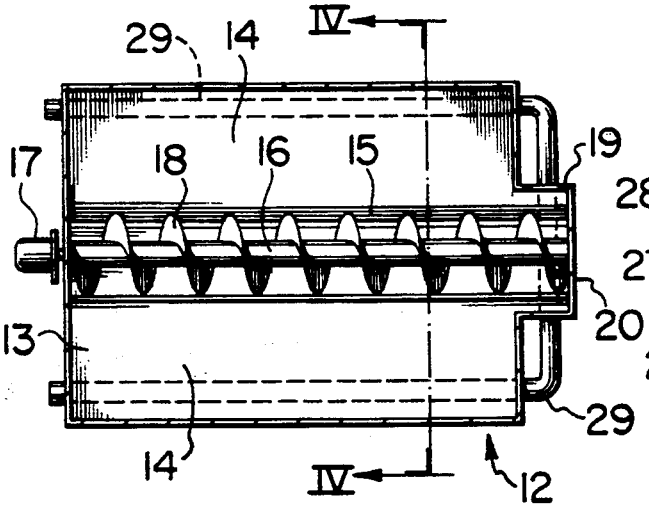
FIG. 3 is a partial sectional view taken on the line III—III in FIG. 1.
Figure 4:
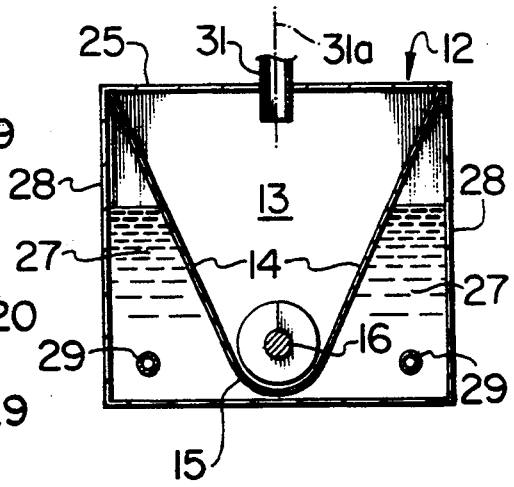
FIG. 4 is a sectional view taken on the line IV—IV in FIG. 3.

As shown in FIG. 1, the soil excavating apparatus is provided on a heavy duty self-propelled truck vehicle 10 having a forward cab portion 11 and a rearward payload portion 12. As shown more clearly in FIGS. 3 and 4, the portion 12 is of large box-like shape and incorporates a plurality of tanks, specifically a large holding tank 13 which extends the full length of the portion 12 and has sloping side walls 14 that converge downwardly to a longitudinally extending rounded bottom trough 15. Nested in the trough 15 is a longitudinally arranged auger 16 which is rotatably mounted and coupled to be driven by a motor 17 at its forward end. The motor 17 can be a hydraulic motor driven from a hydraulic system (FIG. 9) in the vehicle 10. The auger has a continuous helical flight 18 that leads to a discharge chute 19 at the rear of the vehicle, the discharge chute being closed by a pivoted lid 20 which may be hydraulically controlled.

Figure 2:
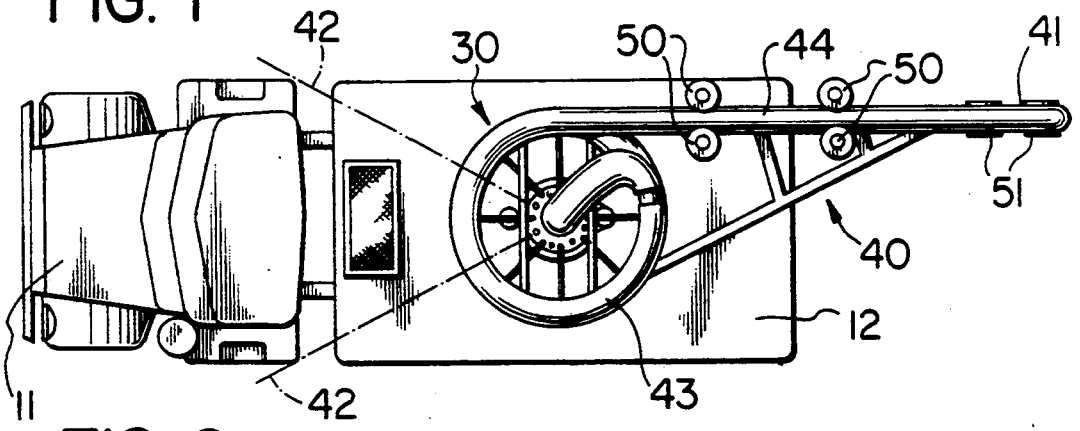
FIG. 2 is a plan view thereof.

At the forward end of the roof 25 of the holding tank 13 is positioned a high volume air discharge fan 26 that communicates with the interior of the holding tank. On the upper side of the holding tank are four large circular doors 21 (FIG. 2) which normally close similarly shaped large openings in the roof 25, but which can be rapidly blown off in response to overpressure in the tank 13 so that in the event of an explosion in the tank, the doors 21 will blow out and rapidly relieve the overpressure thus saving the tank from destruction.

On each side of the holding tank there is a clean water storage tank 27 which occupies the space between the holding tank side walls 14 and the outer walls 28 of the payload portion 12. This configuration largely insulates the holding tank from atmospheric conditions so that its contents do not readily freeze during cold weather operations. Suitable valves and conduits (not shown) are provided for supplying water to the tanks 27 and for removing it. The tanks 27 include heating means whereby heat can be applied to water stored in the tanks. As shown the heating means comprise tubes 29 schematically shown in FIGS. 3 and 4 by which hot exhaust gases from the engine of the vehicle can be ducted in indirect heat exchange relationship to the water in the tanks 27.

The payload portion 12 provides a platform for a turntable 30 that is mounted on suitable thrust bearings (not shown) to rotate about a vertical axis 31a defined by a tubular hub 31, pivot about the hub 31 by an annular thrust bearing 32. The hub 31 is fixed relative to the tank roof 25 and opens into the interior of the holding tank 13.

Attached to the turntable 30 is one end of a horizontally extending boom 40 having a free end 41 that extends beyond the confines of the vehicle 10. Together with the turntable boom can be pivoted from the position shown in FIG. 2 throughout a large range of angular movement, e.g. at least 340°, as indicated by the arrows 42 in FIG. 2. Rotation of the turntable and boom is controlled by the operator through a hydraulic motor 32 operating through a bevel gear drive 33 to a ring gear 34 carried by the turntable. The boom is also designed to be telescopically extensible, e.g. to a length about 8 feet in excess of what is shown, to increase the area that can be accessed by the apparatus. Telescoping is controlled by a hydraulic actuator 40*a*. The boom is of any suitable construction to provide a strong yet lightweight structure, and may as shown be fabricated as an open metal framework.

The turntable 30 provides a rotary support for a reel 43 which is of large diameter and has wound therearound a portion of a flexible hose 44 one end of which extends radially inwardly and then curves to enter the tubular hub 31, this end of the hose being connected to the hub 31 by a rotary tubular seal 45. Rotation of the reel 43 relative to the turntable 30 is controlled by a hydraulic motor 35 acting through a sprocket and chain drive 36. The hose 44 can be of any suitable size, typically having an internal diameter of 6 or 8 inches. The hose is constructed of heavy duty rubber embodying a wire helix embedded between textile cords and encased in a black smooth abrasion and weather-resistant rubber. The hose is flexible yet relatively stiff so that it will not collapse under full vacuum conditions and yet can be bent to a relatively small bend radius, e.g. about 24 inches. The 6 inch internal diameter hose will have an outside diameter of about 6.75 inches and a weight of about 6.4 lbs/foot length.

As noted, the reel 43 is rotatable about its vertical axis and carries thereon an excess length of the hose 44 which can be paid off or wound onto the reel by rotation of the latter.

Figure 5:
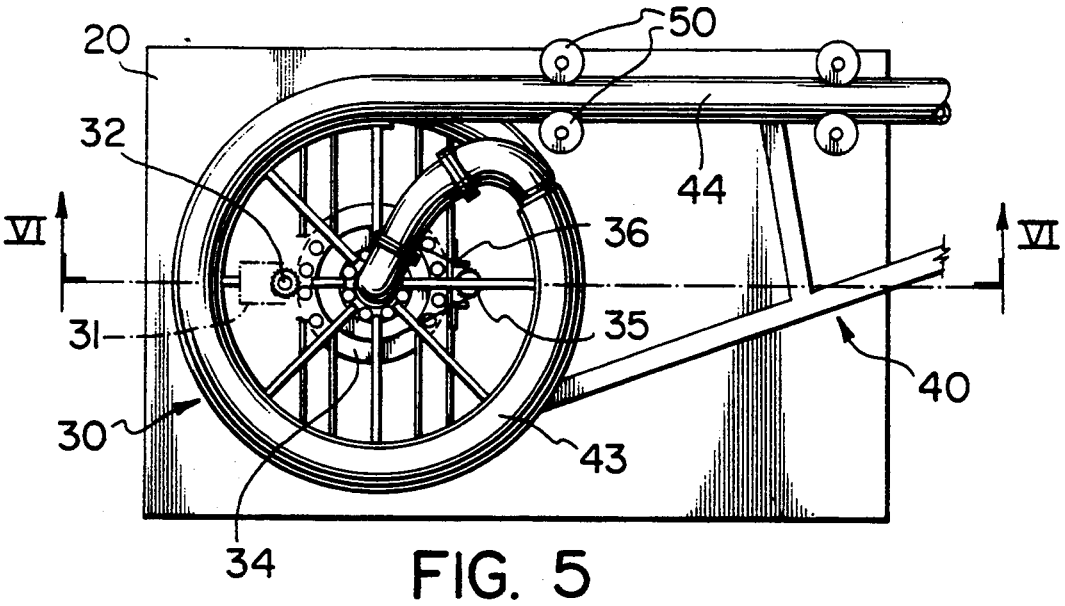
FIG. 5 is an enlarged fragmentary plan view showing a detail.
Figure 6:
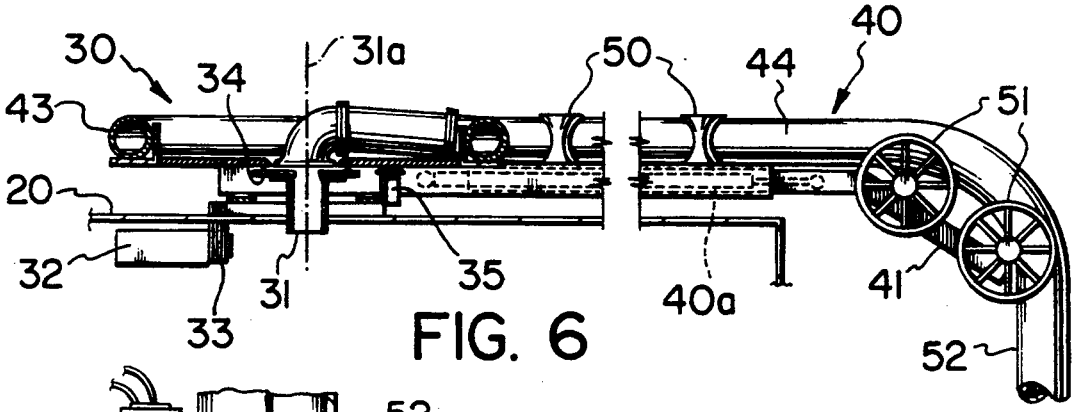
FIG. 6 is a fragmentary sectional view taken on the line VI—VI in FIG. 5.

The hose 44 leaves the spool in a generally tangential direction and passes between guide rollers 50 arranged in pairs spaced along the boom (FIG. 5). At the free end 41 of the boom the hose passes over angularly offset sheaves 51 and changes direction from horizontal to vertical in an end section 52 that depends from the free end 41 of the boom 40.

Figure 7:
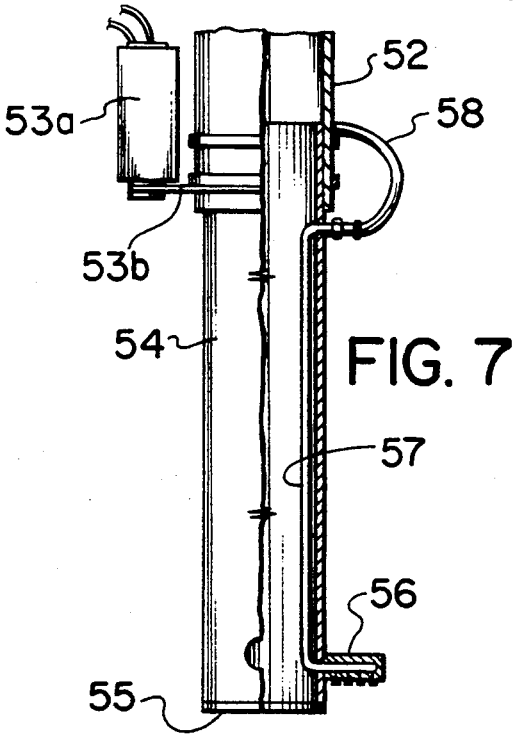
FIG. 7 is a partially sectioned view of a cutting tool portion of the apparatus.

As best seen in FIG. 7, the end section 52 of the flexible hose 44 is connected through a power driven swivel coupling 53 to a co-axial cylindrical cutting tool pipe 54 of rigid material. The swivel coupling can be driven by a hydraulic motor, or as shown, by an electric motor 53a bolted on the top section 52 and driving the bottom section 54 via a V-belt and pulley drive 53*b*. The swivel joint 53 is constructed with internal bearings (not shown) that can be lubricated in conventional fashion. The pipe is of hard metal and has an open lower end which carries a peripheral protective plastics ring 55. This ring 55 prevents damage to the coating of underground utility pipes and the like should they be contacted by the lower end of the tool. Radially extending from the pipe near its lower end is an array of downwardly directed water nozzles 56 supplied with water through a high pressure water line 57 which passes within the pipe 54 and exits from the upper end of the pipe and is connected to a flexible section 58 which bridges the swivel coupling 53, the line 57 ultimately being connected to the storage tanks 27.

Figure 8:
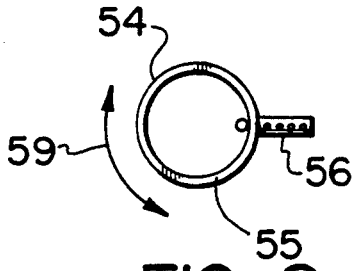
FIG. 8 is an underneath view of the cutting tool of FIG. 7.

As indicated by the arrow 59 in FIG. 8 the pipe 54 is rotatable about its vertical axis with respect to the hose 44. Such rotation is effected by the electric motor 53*a* controlled by the operator and causes the nozzles 56 to move angularly about the envelope of the pipe 54.

Figure 9:
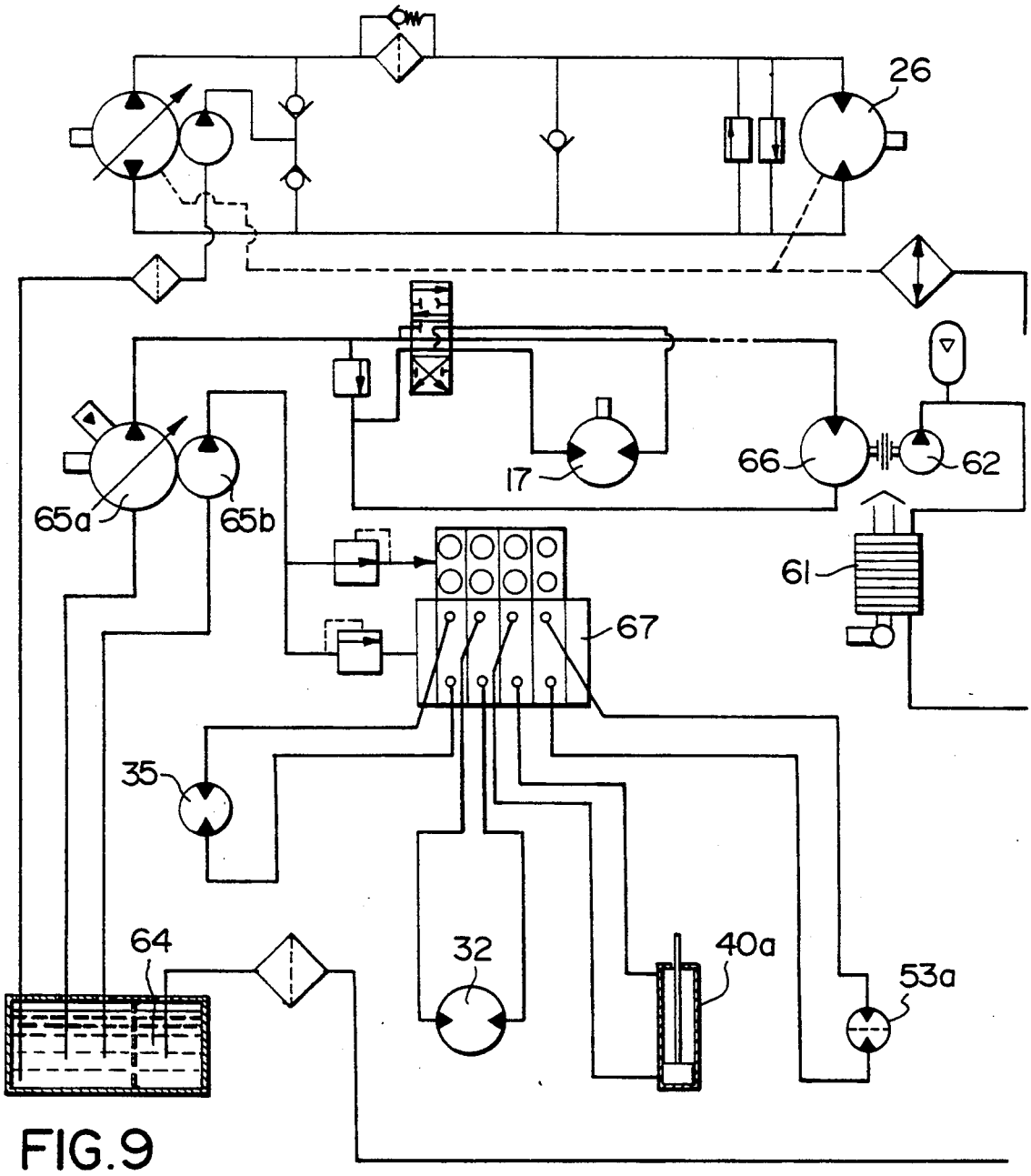
FIG. 9 is a schematic view showing some details of the electro-hydraulic operating systems of the apparatus.

The hydraulic control circuit for operation of the apparatus is schematically shown in FIG. 9 from which it will be seen that hydraulic fluid from a reservoir 64 is drawn and pressurized by two pumps 65*a* and 65*b* for delivery to the various hydraulic motors of the apparatus such as the fan motor 26, the auger drive motor 17, the pump motor 66, the swivel coupling motor 53*a*, the hydraulic actuator 40*a*, the boom rotating motor 32 and the hose reel motor 35. Operation of many of these motors and actuators is effected through a solenoid control valve 67 which can be remotely actuated by an operator who stands on the ground adjacent the cutting tool pipe 54 so that he can monitor its progress.

The operation of the above described apparatus is as follows:

The vehicle 10 is driven to the site to be excavated, and with the cutting tool pipe 54 suspended vertically above ground level, the boom 40 is swivelled horizontally about the axis 31*a* and extended as required by means of the actuator 40 to position the cutting tool pipe 54 in the desired location. The reel 43 is then rotated by the motor 35 and chain drive 36 to lower the bottom ring 55 against the ground, and simultaneously high pressure water is pumped through the nozzles 56 to loosen soil immediately below the cutting tool pipe 54, the pipe 54 being rotated so that the nozzles 56 can operate around the entire periphery of the tool.

Prior to the water supply being initiated, the air discharge fan 26 is actuated to draw air out of the holding tank 13 creating a vacuum therein which is communicated through the tubular hub 31 and the hose 44 to draw loosened soil, air and water upwardly through the cutting tool pipe 54. As this is done, the cutting tool pipe 54 is progressively lowered into the hole created by the high pressure water jets delivered from the nozzles 56 until the hole has reached the desired depth. Throughout the cutting operation, the water and displaced soil are continuously drawn through the hose 44 into the holding tank 13. This action will create an essentially cylindrical hole to the desired depth into the soil.

It will be appreciated that the apparatus can be utilized to excavate a continuous trench, this being done by movement of the boom and/or the vehicle together with control of the cutting nozzles to operate towards one side only of the hole, and repeated vertical reciprocations of the cutting pipe 54 as the movement progresses.

It will be noted that the boom 40 of the above described and illustrated apparatus is "raiseless", i.e. its free end 41 does not have to move vertically to effect raising and lowering of the cutting tool pipe 54, but rather this is effected by advancing and retracting the hose 44 relative to the boom. This provides an important safety factor particularly when operating in locations with limited headroom, since there is no possibility of the boom being raised into contact with overhead obstructions such as power cables.

The overall height of the machine illustrated including the hose reel 43 is approximately 3.8 meters, and the cutting tool 54 can be lowered to extend an excavation down to a depth of 6.5 meters or more below ground, without any need for making connections or adding pieces of pipe or hose.

By the arrangement of the heating tubes 29 passing through the clean water tanks 27, the water is prevented from freezing thus enabling the apparatus to operate in cold climates. In the embodiment shown, a boiler 61 (FIG. 9) is included through which water from a pump 62 is directed en route to the discharge nozzles 56, the water being heated in the boiler 61 to almost its boiling point to enable operation of the apparatus in extremely cold temperature conditions at rates up to 300% faster than conventional equipment. This also enables use of the apparatus to do excavation in frozen ground around delicate utility lines.

By mounting of the water nozzles 56 outwardly of the pipe 54 the interior of the latter remains essentially unobstructed, allowing for the free movement of return air and water to lift sizable pieces of debris or loosened soil. The cutting nozzles 56 are set back upwardly from the plastic ring 55 at the lower end of the cutting pipe which reduces the likelihood of damage being done to lines that are being uncovered.

Excavations of the nature described often have to be effected in soil where there is a gas leak. The explosive damping doors 21 in the roof of the holding tank 13 enable the apparatus to operate safely under such conditions since in the event of an explosion in the holding tank, these doors will blow out, essentially avoiding damage to the machine or injury to workers.

The provision of the unloading auger 16 in the holding tank 13 is an important feature, particularly where the excavation is being performed in contaminated soil. The auger provides the opportunity of controlling discharge of material from the tank 13. Thus rather than simply an uncontrolled dumping of the material, the auger enables the material to be off-loaded into barrels, plastic bags, small tanks etc.

It is also possible to effect larger or irregularly shaped excavations by providing in place of the cutting tool 54 and hose 44, a hand held wand (not shown) coupled to the holding tank through a smaller hose and carrying water nozzles, movements of the wand being controlled manually by the operator.

I claim:

1. Soil excavating apparatus comprising:

a platform;

an elongate boom mounted on said platform and having a free end that is angularly movable in a horizontal direction about said platform;

an extendible flexible tubular conduit carried by said boom and having one end associated with said platform and connectable to a source of suction, said conduit extending longitudinally of the boom and having a second end suspended to hang vertically from said boom at a spacing from said platform, said second end terminating in a tubular pipe having a lower end adjacent which said tubular pipe carries downwardly directed nozzle means;

said conduit being extendible and retractable to selectively raise or lower said pipe independently of said boom, and said nozzle means being angularly shiftable about the axis of said pipe;

such that said pipe can be lowered into the ground to excavate a hole by delivery of high pressure fluid through said nozzle means to loosen soil, and by removal of such loosened soil through said conduit by suction.

2. Soil excavating apparatus as claimed in claim 1 wherein said platform is provided on the upper side of a vehicle to pivot about a vertical axis thereon.

3. Soil excavating apparatus as claimed in claim 2 wherein said one end of the conduit is connected to a holding tank in said vehicle, said holding tank communicating with means adapted to create a vacuum in said holding tank.

4. Soil excavating apparatus as claimed in claim 3 wherein said vehicle also includes a water storage tank and a pressure pump connected to deliver water to said nozzle means through a pressure line.

5. Soil excavating apparatus as claimed in claim 3 wherein said holding tank has in the lower portion thereof sloping side walls that lead to a narrow elongate rounded base wherein is located an unloading auger that is mounted to rotate about a longitudinal axis and that communicates with a discharge chute through which accumulated soil can be discharged from the bottom of the holding tank.

6. Soil excavating apparatus as claimed in claim 4 including means for heating the contents of said water tank.

7. Soil excavating apparatus as claimed in claim 6 wherein said heating means comprises means for ducting exhaust flow from the engine of said vehicle in indirect heat exchange relationship with the contents of the water tank.

8. Soil excavating apparatus as claimed in claim 1 wherein said tubular conduit is of substantially inextensible material, said platform including storage means adapted to accommodate excess length of said tubular conduit, raising or lowering of said pipe being effected by paying out or retracting such excess length.

9. Soil excavating means as claimed in claim 8 wherein said storage means comprises a reel around which a portion of said conduit is wound, said reel having an axis of rotation, rotation of said reel in one direction or the other being effective to increase or decrease the length of conduit wound thereon.

10. Soil excavating means as claimed in claim 9 wherein said one end of the conduit passes axially through said reel.

11. Soil excavating means as claimed in claim 10 wherein said reel is arranged with said axis of rotation vertical, said axis of rotation also constituting a pivotal axis for said boom.

12. Soil excavating means as claimed in claim 11 wherein said conduit is guided to move from said reel and longitudinally of said boom by roller means mounted on said boom.

13. Soil excavating means as claimed in claim 1 including bearing means enabling said pipe to be rotated about a vertical axis relative to the second end of said conduit.

14. Soil excavating means as claimed in claim 13 wherein said pipe is of metal and terminates at its lower end in a plastic ring.

15. Soil excavating means as claimed in claim 13 wherein said nozzle means comprises a nozzle projecting radially from said pipe near the lower end thereof, said nozzle moving angularly about the axis of the pipe upon rotation of said pipe.

16. Soil excavating apparatus as claimed in claim 1 wherein said platform is mounted on the upper side of a vehicle to pivot about a vertical axis thereon, said one end of the conduit being connected to a holding tank on said vehicle, said holding tank communicating with an exhaust fan adapted to create a vacuum in said holding tank.

17. Soil excavating apparatus as claimed in claim 16 wherein said tubular conduit is of substantially inextensible material, said vehicle including storage means adapted to accommodate an excess length of said tubular conduit, raising or lowering of said pipe being effected by paying out or retracting such excess length.

18. Soil excavating apparatus as claimed in claim 17 wherein said storage means comprises a reel carried on said platform and around which a portion of said conduit is wound, said reel having an axis of rotation, said one end of the conduit passing axially through said reel to communicate with said holding tank, rotation of said reel in one direction or the other being effective to increase or decrease the length of conduit wound thereon, and thus pay out or retract said excess length.

19. Soil excavating apparatus as claimed in claim 18 wherein said spool is arranged with the axis of rotation thereof vertical, said axis also constituting a pivotal axis for an end of the boom, said conduit being guided to move from said reel longitudinally of said boom by roller means mounted on said boom.

20. Soil excavating apparatus as claimed in claim 16 wherein said holding tank has in the lower portion thereof sloping side walls that lead to a narrow elongate rounded base wherein is located an unloading auger that is mounted to rotate about a longitudinal axis and that communicates with a discharge chute through which accumulated soil can be discharged from the bottom of the holding tank.

21. Soil excavating apparatus as claimed in claim 16 wherein said vehicle also carries a water storage tank that is connected through a pressure line to deliver water to said nozzle means, said vehicle further including means for heating the contents of said water tank.

22. Soil excavating means as claimed in claim 16 wherein said pipe is rotatable about a vertical axis relative to the second end of said conduit, said nozzle means comprising a nozzle that projects radially from said pipe near the lower end thereof, said nozzle moving angularly about the axis of said pipe upon rotation of said pipe.

23. Soil excavating apparatus as claimed in claim 4 including high pressure line means to deliver fluid to said nozzle means, and further including boiler means to pre-heat such fluid before it is delivered to said nozzle means.

24. Soil excavating apparatus as claimed in claim 1 wherein said boom is horizontally extensible and retractable.

25. Soil excavating apparatus as claimed in claim 24 wherein extension and retraction movements of the boom are controlled by a linear hydraulic actuator.

26. Soil excavating apparatus comprising:

a vehicle;

a platform mounted on said vehicle to pivot about a vertical axis;

an elongate boom mounted on said platform and having a free end that is angularly movable in a horizontal direction upon pivoting of said platform about said vertical axis;

an extendible flexible tubular conduit carried by said boom and having one end associated with said platform and connectable to a source of suction on said vehicle, said conduit extending longitudinally of the boom and having a second end suspended to hang vertically from said boom at a spacing from said vehicle, said second end terminating in a tubular pipe having a lower end adjacent which said tubular pipe carries downwardly directed nozzle means, said nozzle means being angularly shiftable about the periphery of said pipe;

means for selectively extending and retracting said conduit relative to said boom to selectively raise or lower said pipe independently of said boom; and means to deliver liquid under high pressure to said nozzle means such that through movement of said conduit relative to said boom said pipe can be lowered into the ground to excavate a hole by the action of high pressure liquid passing through said nozzle means to loosen soil, and by removal of such loosened soil through said conduit by suction.

27. Soil excavating apparatus as claimed in claim 26 wherein said boom is horizontally extendible and retractible to enable positioning of said tubular pipe at a desired spacing from said vehicle.

28. Soil excavating apparatus as claimed in claim 27 wherein said tubular conduit is of substantially inextensible material, said platform including storage means adapted to accommodate excess length of said tubular conduit, said storage means comprising a reel around which said excess length of conduit is wound, rotation of the reel in one direction or the other being effective to increase or decrease the length of conduit wound on the reel and hence to respectively raise or lower said tubular pipe.

29. Soil excavating apparatus as claimed in claim 27 wherein said one end of the conduit is in communication with the interior of a holding tank on said vehicle, said holding tank also communicating with an exhaust fan that is operable to create a vacuum in said holding tank.

30. Soil excavating apparatus as claimed in claim 29 wherein said vehicle further includes a storage tank to contain water which constitutes the liquid to be delivered under high pressure to said nozzle means, said vehicle further including means for heating the contents of said water storage tank.

* * * * *